US005767620A

United States Patent [19]

Onodaka

[11] Patent Number: 5,767,620

[45] Date of Patent: Jun. 16, 1998

[54] FIELD-EMISSION DEVICE WITH MULTIPLE EMITTER TIPS

[75] Inventor: Koji Onodaka, Mobara, Japan

[73] Assignee: Futaba Denshi Kogyo K.K., Mobara, Japan

[21] Appl. No.: 665,983

[22] Filed: Jun. 19, 1996

[30] Foreign Application Priority Data

Jun. 20, 1995 [JP] Japan ..... 7-175568

[51] Int. Cl.[6] ..... H01J 1/62; H01J 1/30

[52] U.S. Cl. ..... 313/495; 313/309; 313/497; 313/336

[58] Field of Search ..... 313/495, 496, 313/497, 309, 336, 351

[56] References Cited

U.S. PATENT DOCUMENTS 5,534,749 7/1996 Ohoshi et al. ..... 313/497
5,548,181 8/1996 Jones ..... 313/309
5,583,393 12/1996 Jones ..... 313/309
5,587,623 12/1996 Jones ..... 313/309
5,592,205 1/1997 Shimizu et al. ..... 313/495

*Primary Examiner*—Sandra L. O'Shea
*Assistant Examiner*—Joseph Williams
*Attorney, Agent, or Firm*—Oblon, Spivak, McClelland, Maier & Neustadt, P.C.

[57] ABSTRACT

To decrease the number of a cathode power source for operating a portion between the cathode and the gate, a structure is employed in which three gate lines for red, green and blue filters are provided, the filter being arranged such that the red optical filter has a lowest radiant efficiency, the blue optical filter has a secondly low radiant efficiency and the green optical filter has a highest radiant efficiency. In inverse proportion to the radiant efficiencies, the numbers of emitters in field-emission arrays formed in the three gate lines are determined.

8 Claims, 8 Drawing Sheets

RADIANT POWER CURVE OF ZnO : Zn PHOSPHOR AND TRANSMITTANCE OF FILTERS

FIELD-EMISSION DEVICE WITH MULTIPLE EMITTER TIPS

BACKGROUND OF THE INVENTION

1. Field of the Invention

The present invention relates to a field-emission device, and, more particularly, to a device for displaying a color image using field-emission elements.

2. Description of the Related Art

An example of the foregoing device according to the present invention and formed into a print head for printing a color image will now be described.

Hitherto, optical printers have been known. The schematic structure of the optical printer will now be described with reference to FIG. 1. A film 120 is coated with a sensitive material, such as silver halide (silver salt), so as to be exposed to light when the lower surface of the film 120 is irradiated with light reflected by a mirror 121.

The film 120 is irradiated with light emitted from a print head 125. The print head 125 is supplied with image data for each line. Light modulated by image data above is main-scanned vertically on the surface of the drawing sheet and the print head 125 is sub-scanned as indicated by an arrow shown in FIG. 1 so that one image is printed on the film 120 by a line sequential method.

Reference numeral SLA 122 represents a SELFOC lens array serving as a lens for causing light emitted from the print head 125 to be focused on the surface of the film 120. A mirror 123 introduces light into the SLA 122.

An RGB filter 124 is an optical filter of three primary colors for printing a color image on the film 120. In a case where a color image is printed, image data for one line is decomposed into R (Red), G (Green) and B (Blue) image data, and then the RGB filter 124 is sequentially moved to correspond to image data for each color so that the main scanning operations are performed three times.

That is, the main scanning operations performed by three times result in the color image for one line being recorded on the film 120.

An optical printer includes the foregoing print head having a light source which has been a light emitting diode (LED) or a fluorescent character display tube of a thermionic emission type. In recent years, use of semiconductor microprocessing technique has enabled micron size field-emission devices to be formed into an array configuration on a substrate. A field-emission print head using the foregoing field-emission device array as the electron source has been suggested (refer to Japanese Patent Laid-Open No. 4-43539).

An example of the structure of a conventional field-emission print head of the foregoing type is shown in FIG. 2. In FIG. 2, FIG. 2A is a schematic plan view, FIG. 2B is a schematic cross sectional view taken along line A—A' shown in FIG. 2A, and FIG. 2C is a detailed cross sectional view taken along line B—B' shown in FIG. 2A. As shown in FIG. 2, the field-emission print head has a first flat substrate 101 having a plurality of field-emission devices 105 formed thereon, a second flat substrate 102 disposed opposite to the first flat substrate 101 and having a fluorescent member 106 and so forth formed thereon, a holder member 103 for maintaining a predetermined distance from the first flat substrate 101 to the second flat substrate 102, and a vacuum layer 104 surrounded by the first flat substrate 101, the second flat substrate 102 and the holder member 103.

The first flat substrate 101 is made of an n-type silicon single crystal substrate and covered with a silicon oxide film ($SiO_2$ film) 101' except the field-emission devices 105 and the substrate contact electrode 107 thereof. The second flat substrate 102 is made of a transparent glass substrate and having a transparent anode electrode 109 and a fluorescent member 106 laminated on the surface thereof. The field-emission devices 105, each having a cathode electrode and a gate electrode, and the fluorescent member 106, having the anode electrode, are disposed opposite to each other in such a manner that the vacuum layer 104 is formed between the field-emission devices 105 and the fluorescent member 106. A pair of the field-emission device 105 and the fluorescent member 106 form a unit light source. Each unit light source has one field-emission device sectioned by gate electrodes from one another and disposed in the form of an array. The cathode electrode of each of the field-emission device shares the monocrystal silicon plate. Also the anode electrode is commonly shared.

One field-emission device, as shown in FIG. 2C, has a plurality of projecting cathode electrodes (emitters) 111 formed on the surface of the first flat substrate 101 and gate electrodes 112 formed on the $SiO_2$ film 101' and having openings adjacent to the foregoing projections. The gate electrodes 112 are separated from one another by each field-emission device.

Although the first flat substrate 101 is made of the single crystal silicon substrate and the projections are formed by anisotropic etching of the single crystal silicon substrate, an insulating substrate having metal electrodes and metal projections may be employed or a structure having metal projections formed on a conductive substrate may be employed.

In the thus-structured unit light source in a state where the single crystal silicon substrate 101 is grounded through the substrate contact electrode 107, when anode voltage $V_{ak}$ is applied to the fluorescent member 106 through the anode contact electrode 110 and the anode electrode 109 and gate voltage $V_{gk}$ is applied to the gate electrode of the field-emission devices 105 through the gate contact electrode 108, the electric field of the gate electrode is applied to the projection portions of the cathode electrodes of the field-emission devices 105 so that electrons are field-emitted from the leading portions of the projections. The field-emitted electrons are accelerated due to the anode voltage when allowed to reach the fluorescent member 106 so that the portions of the fluorescent member 106 opposite to the device emit light.

Thus-emitted light is radiated through the transparent anode electrode 109 and the second flat substrate 102 so that image data for one line is emission-recorded on a recording medium, such as a film. In the foregoing case, the line sequential scan method may be employed as described above, in which the recording medium or the print head is moved to record image data for the following one line. At this time, the RGB filter 124 is moved to perform the main scan so that color image is recorded.

Since a field-emission print head of the foregoing type is manufactured by using the microprocessing technique for semiconductors, high resolutions can be realized.

An example of a circuit for operating the print head for recording a color image is shown in FIG. 3 which is structured such that one gate line GT1 and n cathode lines Cl to Cn, running perpendicular to the gate line GT1, are formed on a cathode substrate; an anode line covered with an elongated fluorescent member is formed on an anode substrate to be opposite to the gate line GT1; and the color filter of the three primary colors is employed as shown in FIG. 1.

Referring to FIG. 3, the n cathode lines Cl to Cn respectively are operated by cathode drivers in a cathode driver group 126. The cathode driver group 126 is supplied with image data, corresponding to any one of colors for one line, and control signals.

The gate line GT1 is operated by a gate operation circuit 130. The gate operation circuit 130 generates an operation pulse of the level of the voltage supplied from a gate power source 131.

In a case where the filter is, for example, positioned in such a manner that light emitted from the fluorescent member covering the gate line 1 penetrates the R (red) filter, red image data is supplied to the cathode driver group 126 so that the cathode lines Cl to Cn are respectively controlled in accordance with the red image data. As a result, portions (portions in which the field-emission devices are formed) of the gate line GT1 overlapping the cathode lines Cl to Cn are caused to emit light from the fluorescent member thereof due to emitted electrons corresponding to the image data for a red image so that light penetrates the red filter.

Since no efficient fluorescent material capable of emitting light covering the overall wavelength region of red, green and blue has been available as yet and the transmission efficiencies of the filters of the three primary colors are different from one another, the voltage levels to be supplied to cathode lines Cl to Cn are controlled in accordance with the colors, that is, red, green and blue in order to make the quantities of red, green and blue light beams, which have penetrated the red, green and blue filters, to be the same.

Therefore, a power source 127 for red, a power source 128 for green and a power source 129 for blue are provided. In a case where image data for, for example, red, is supplied to the cathode driver group 126, a power-source switch, the switching operation of which is controlled in accordance with a color selection signal, is operated to select the power source 127 for red so that electric power is supplied to the cathode driver group 126. As a result, electrons in a quantity which is in inverse proportion to the radiant efficiency of the red filter are emitted from the gate line GT1. Also in cases where green and blue image data it ems are supplied to the cathode driver group 126, a similar control is performed so that the quantities of red, green and blue light beams, which have penetrated the corresponding filters, are made to be the same.

However, the conventional field-emission print head is required to have three power sources for red, green and blue images and, therefore, involves increase in the number of parts thereof. Since a circuit for controlling the three power sources is required, the operation circuit becomes too complicated and the cost of the same cannot be reduced.

SUMMARY OF THE INVENTION

Accordingly, an object of the present invention is to provide a field-emission print head capable of simply structuring an operation circuit for making, constant, the quantities of three primary colors for use to irradiate a recording medium.

To achieve the foregoing object, according to one aspect of the present invention, there is provided a field-emission print head including: a plurality of cathode lines formed on a cathode substrate; a plurality of gate lines formed on the cathode lines through an insulating layer in such a manner that the plurality of gate lines are formed perpendicular to the cathode lines; a plurality of effective emitters formed in portions in which the cathode lines and the gate lines overlap in such a manner that the plurality of effective emitters are formed on the cathode lines disposed in openings formed in the, gate lines; and an anode substrate disposed opposite to the cathode substrate and having a plurality of anode lines covered with fluorescent layers of different colors in portions opposite to the plurality of gate lines, wherein the number of the effective emitters formed opposite to the fluorescent layers is inverse proportion to radiant efficiencies of the opposite fluorescent layers for respective colors.

According to another aspect of the present invention, there is provided a field-emission print head including: a plurality of cathode lines formed on a cathode substrate; a plurality of gate lines formed on the cathode lines through an insulating layer in such a manner that the plurality of gate lines are formed perpendicular to the cathode lines; a plurality of effective emitters formed in portions in which the cathode line sand the gate lines overlap in such a manner that the plurality of effective emitters are formed on the cathode lines disposed in openings formed in the gate lines; an anode substrate disposed opposite to the cathode substrate and having a plurality of anode lines covered with fluorescent layers of different colors in portions opposite to the plurality of gate lines; and color filters using light emitted from the fluorescent layers to obtain a plurality of emitted light colors and disposed opposite to the anode lines, wherein the number of the effective emitters formed opposite to the fluorescent layers is inverse proportion to radiant efficiencies of the corresponding color filters for respective colors.

The field-emission print head has a structure such that the widths of the cathode lines in the portions in which the cathode lines and the gate lines overlap are changed.

The field-emission print head has a structure such that the widths of the gate lines in the portions in which the cathode lines and the gate lines overlap are changed.

The field-emission print head has a structure such that the widths of the cathode lines and the widths of the gate lines in the portion in which the cathode lines and the gate lines overlap are changed.

According to the present invention, only one voltage level is required to be applied between the gate and the cathode when the field-emission print head is operated. Therefore, only one power supply circuit for supplying electric power to the cathode driver group is required. Therefore, the operation circuit can be simplified and the cost of the same can be reduced.

Other objects, features and advantages of the invention will be evident from the following detailed description of the preferred embodiments described in conjunction with the attached drawings.

DETAILED DESCRIPTION OF THE PREFERRED EMBODIMENTS

Figure 4:
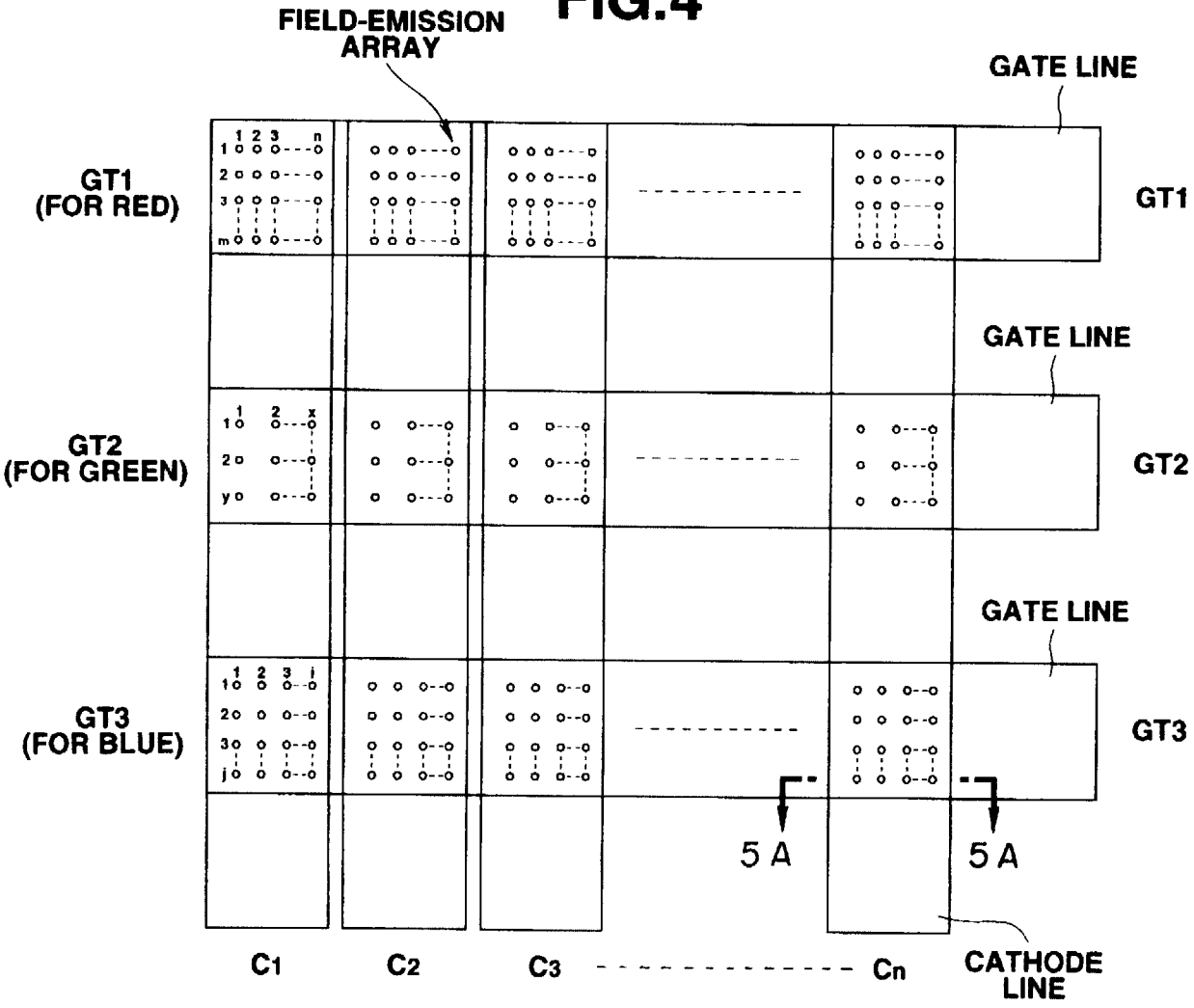
FIG. 4 is a top view of a cathode substrate showing the structure of gate lines and cathode lines of a field-emission, print head according to the present invention.
Figure 5A:
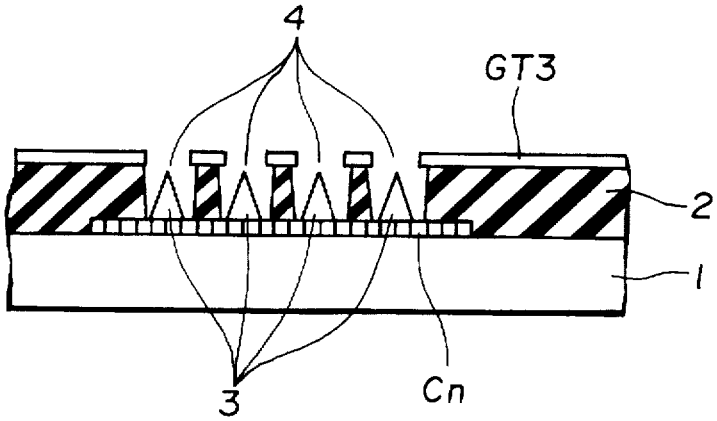
FIG. 5 is a group of a side view showing the field-emission print head according to the present invention and a partial cross sectional view showing the cathode substrate.
Figure 5B:
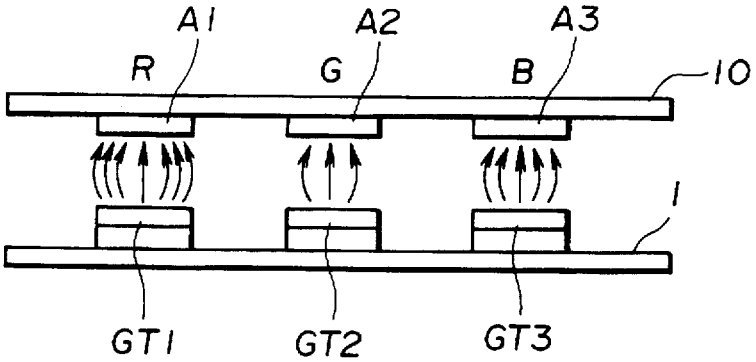
Figure 6:
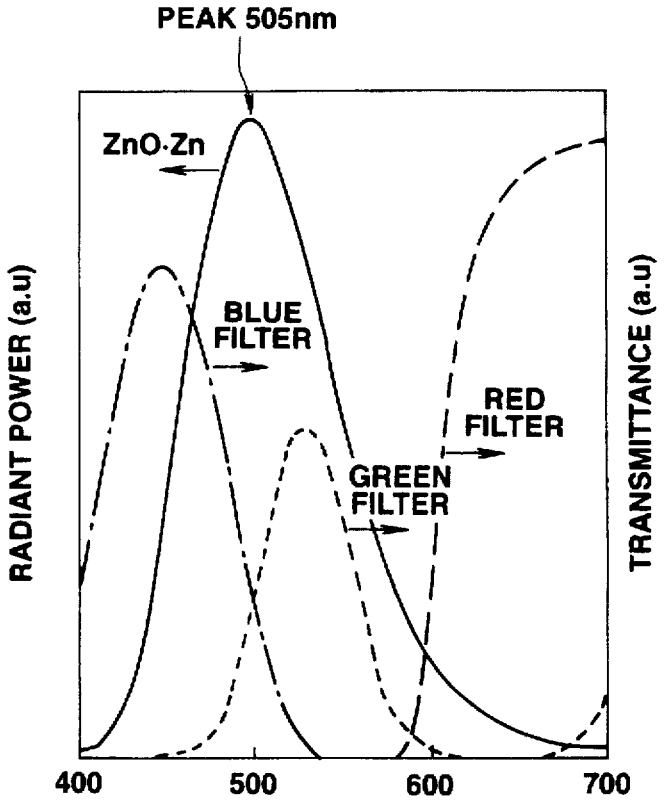
FIG. 6 is a graph showing the radiant characteristics of fluorescent materials and transmittance of optical filters.
Figure 7:
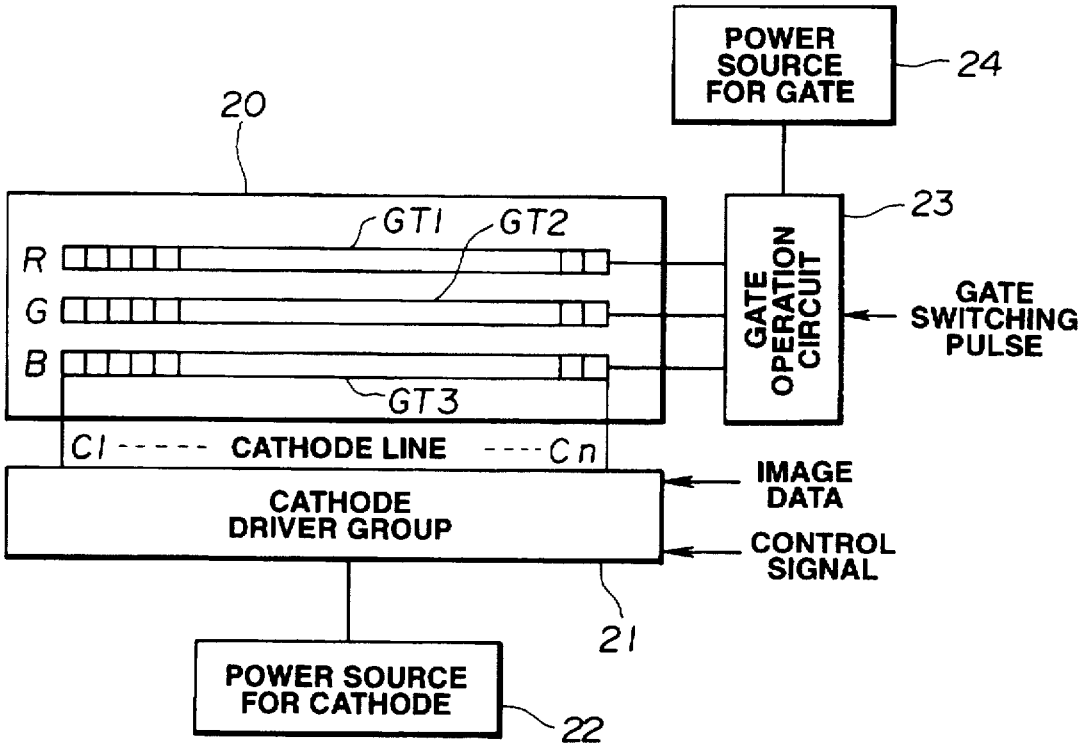
FIG. 7 is a circuit diagram showing an example of a circuit for operating the field-emission print head according to the present invention.

An embodiment of a field-emission print head according to the present invention will now be described with reference to FIGS. 4 to 7. FIG. 4 shows an example of gate lines and cathode lines when a cathode substrate 1 forming the field-emission print head according to the present invention is viewed from an upper position. FIG. 5A shows the cross sectional structure of a portion of the cathode substrate 1. FIG. 5B shows the schematic structure of the side surface of the field-emission print head. FIG. 6 is a graph showing the radiant power characteristic of a fluorescent material and the transmittance characteristics of optical filters. FIG. 7 shows an example of a circuit for operating the field-emission print head.

On a surface of a cathode substrate (not shown), there are formed a plurality of cathode lines C1, C2, C3 . . . , Cn, as shown in FIG. 4. On the cathode lines Cl, C2, C3, . . . , Cn, there are formed three gate lines GT1, GT2 and GT3 while interposing an insulating layer. The three gate lines GT1, GT2 and GT3 are formed substantially perpendicular to the cathode lines C1, C2, C3, . . . . Cn. Each of portions, in which the gate lines GT1, GT2 and GT3 and the cathode lines C1, C2, C3, . . . . Cn overlap, is formed into a field-emission array having a plurality of cone-shape emitters formed thereon.

The gate lines GT1, GT2 and GT3 are controlled by an operation circuit, to be described later, so as to be operated selectively and sequentially. The field-emission print head is formed in such a manner that R (red) light is emitted when the gate line GT1 is operated, G (green) light is emitted when the gate line GT2 is operated and B (blue) light is emitted when the gate line GT3 is operated.

The number of the emitters forming the field-emission array corresponding to the gate line GT1 is, as illustrated, about two times the number of emitters forming the field-emission array corresponding to the gate line GT2. The number of the emitters forming the field-emission array corresponding to the gate line GT3 is about 1.2 times the number of the emitters forming the field-emission array corresponding to the gate line GT2. The reason for this will be described later.

Figure 1:
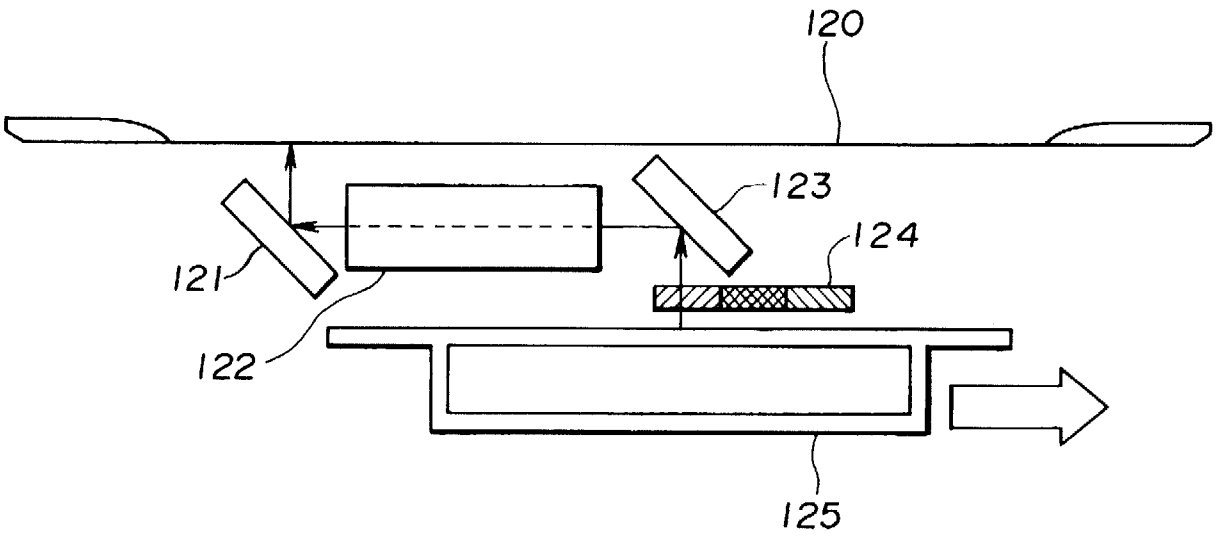
FIG. 1 (PRIOR ART)
FIG. 1 is a schematic view showing the structure of an optical printer using a conventional field-emission print head.
Figure 2A:
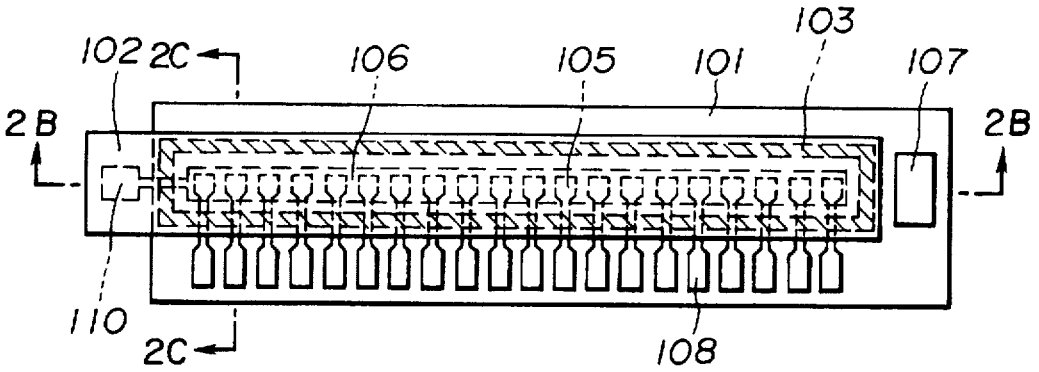
FIG.2A (PRIOR ART)
FIG. 2 is a group of a top view, a front cross sectional view and a side cross sectional view showing the schematic structure of a conventional field-emission print head.
Figure 2B:
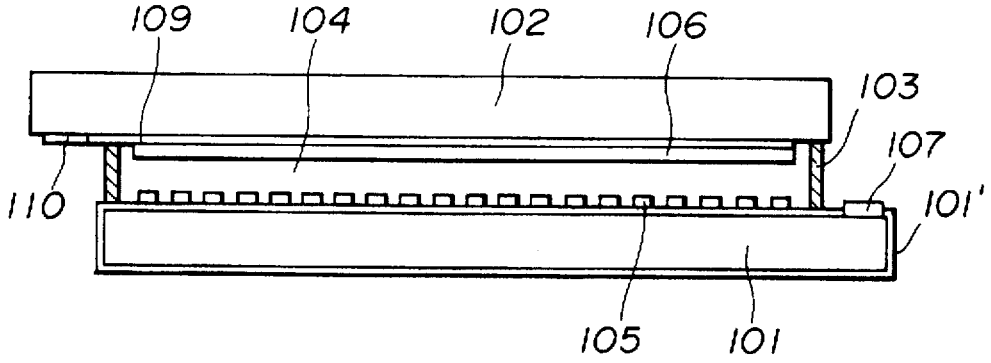
FIG.2B (PRIOR ART)
Figure 2C:
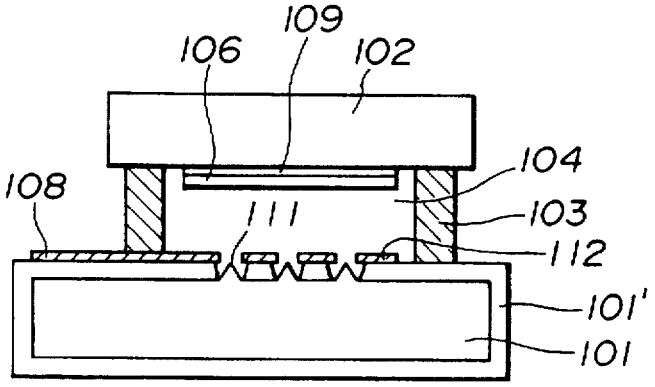
FIG.2C (PRIOR ART)
Figure 3:
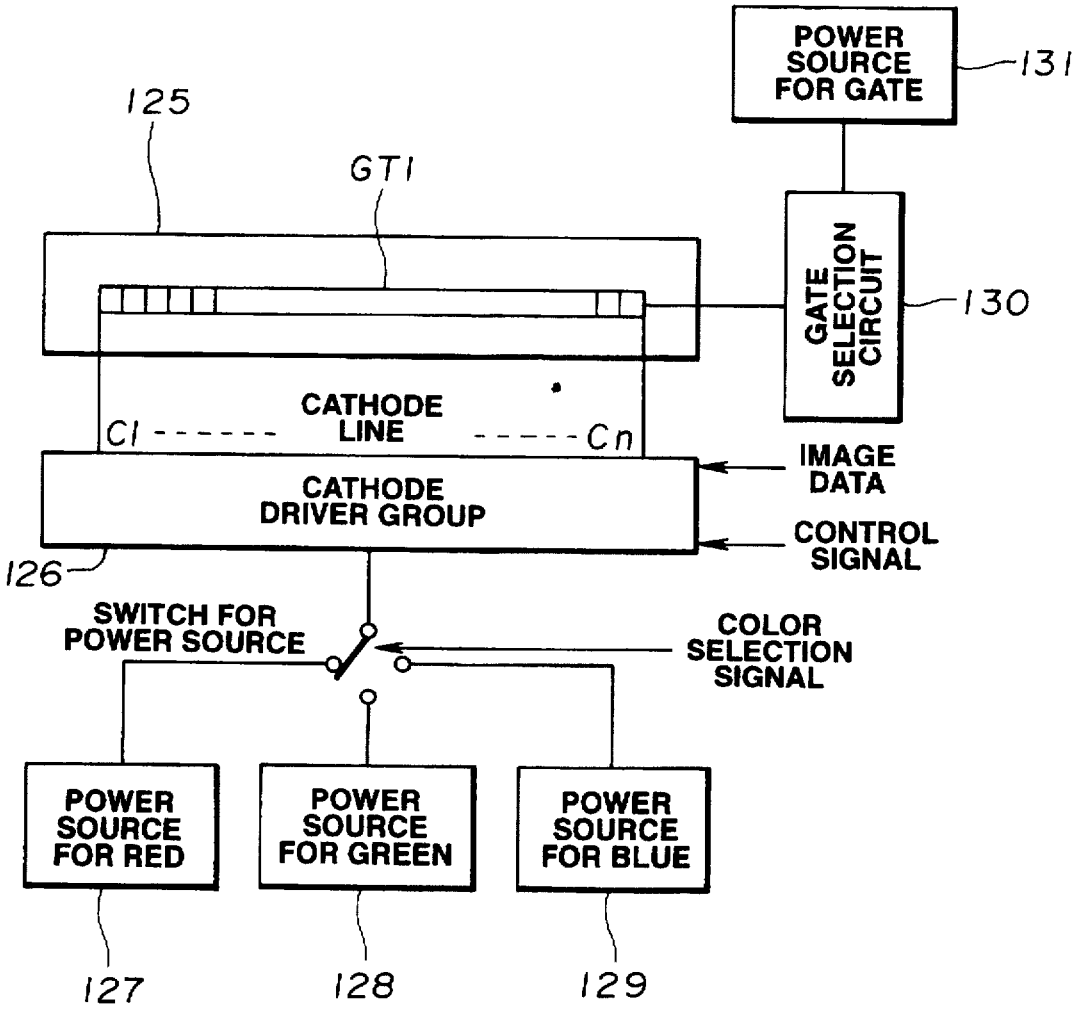
FIG.3 (PRIOR ART)
FIG. 3 is a diagram showing an example of a circuit for operating a conventional field-emission print head.

A cross section taken along line A—A of FIG. 1 is shown in FIG. 5A. As shown in FIG. 5A, n cathode lines C1, C2, C3, . . . . Cn (the cathode line Cn is illustrated in FIG. 5) are formed on, the surface of the cathode substrate 1 made of, for example, glass. Moreover, a gate line GT3 is formed such that an insulating layer 2 is formed between the cathode lines C1, C2, C3, . . . . Cn and the gate line GT3. In each of a plurality of openings 4 formed in the gate line GT3, a cone-shape emitter 3 is formed. In this case, the gate line GT3 is disposed adjacent to the leading end of the emitter 3 and the distance from the leading end of the emitter 3 to the gate line GT3 is made to be about sub-micron.

The cathode substrate 1 having the foregoing structure and an anode substrate disposed opposite to the cathode substrate 1 form the field-emission print head according to the present invention. The schematic structure of the field-emission print head according to the present invention is shown in FIG. 5B.

Referring to FIG. 5B, the cathode substrate 1 has three gate lines GT1, GT2 and GT3 having the field-emission arrays. Three anode lines A1, A2 and A3 disposed opposite to the three gate lines GT1, GT2 and GT3 are formed on an anode substrate 10. The three anode lines A1, A2 and A3 are covered with fluorescent materials of the same type (not shown). Optical filters R, G and B of the three primary colors for transmitting emitted light are formed or disposed on the outside of the anode substrate 10 at positions opposite to the anode lines A1, A2 and A3.

Note that the cathode substrate 1, the anode substrate 10 and side plates (not shown) form a vacuum and airtight container, the inside portion of which is made to be high vacuum.

The radiant power of the fluorescent material covering the anode lines A1, A2 and A3 in a case where the fluorescent material is ZnO;Zn and the transmittance of the optical filters R, G and B are shown in FIG. 6. The radiant power of the fluorescent material ZnO;Zn has a wavelength peak of 505 nm and each of the optical filters R, G and B has the transmittance as shown in FIG. 6. As can be understood from the characteristics above, transmitted light emitted from the filter G is a result of multiplication of the radiant power of the fluorescent material and the transmittance of the filter G. Since the two characteristics overlap, the transmittance of the green light component is enlarged. Since the radiant power of the fluorescent material and the transmittance of the filter B overlap by only about half portions, the transmittance of the blue light component is smaller than that of the green light component. Since the radiant power of the fluorescent material and the transmittance of the filter R do not substantially overlap, the transmittance of red light component is minimized.

The ratio of quantities of transmitted red, green and blue light components when the fluorescent material ZnO;Zn and the optical filters R, G and B each having the foregoing transmittance are used are substantially as follows:

$$R:G:B=0.5:1:0.83$$

To correct the quantity of transmitted red, green and blue light components, the numbers of the emitters for forming the field-emission arrays formed on the gate lines GT1, GT2 and GT3 are made to be different from one another, as shown in FIG. 4.

The ratio of the emitters is made to be in inverse proportion to the ratio of the quantities of transmitted red, green and blue light components. That is, the ratio is as follows:

$$E_R:E_G:E_B=2:1:1.2$$

where $E_R:E_G:E_B$ are the numbers of the emitters respectively formed on the gate lines GT1, GT2 and GT3.

FIG. 5B shows the state where electrons are emitted as indicated by arrows when the gate lines GT1, GT2 and GT3 have been operated. The gate line GT1 having the largest number of the emitters emits electrons by the largest numbers, the gate line GT3 emits electrons by the number second to gate line GT1, and the gate line GT2 emits electrons by the smallest number.

A circuit for operating a field-emission print head 20 according to the present invention is shown in FIG. 7.

Referring to FIG. 7, n cathode lines Cl to Cn formed on the field-emission print head 20 are operated by a cathode driver group 21 having n drivers. The cathode driver group 21 is supplied with image data for one line and control signals so that each of the cathode lines Cl to Cn is operated in accordance with the image data.

The three gate lines GT1, GT2 and GT3 formed on the field-emission print head 20 are selectively and sequentially operated by a gate selection circuit 23. The gate selection circuit 23 generates selectively-operating pulses of a voltage level of a gate power source 24, the selectively-operating pulses being synchronized with supplied gate switching pulses.

When the gate selection circuit 23 is selectively operating the gate line GT1, red image data for one line is supplied to the cathode driver group 21. When the gate selection circuit 23 is selectively operating the gate line GT2, green image data for one line is supplied to the cathode driver group 21. When the gate selection circuit 23 is selectively operating the gate line GT3, blue image data for one line is supplied to the cathode driver group 21. After the gate selection circuit 23 has sequentially and one time operated the gate lines GT1, GT2 and GT3, a color image for one line is recorded on a recording medium by the field-emission print head 20.

The cathode driver group 21 is supplied with electric power from a cathode power source 22 provided solely.

Although the description has been performed about the structure formed such that one type of fluorescent material is employed and the optical filters R, G and B of the three primary colors are employed to obtain light corresponding to image data, the present invention is not limited to the foregoing structure. Fluorescent materials respectively emitting red, green and blue light beams may be provided for the gate lines GT1, GT2 and GT3 to obtain light beams of the three primary colors.

In the foregoing case, the number of emitters to be provided for each of the gate lines GT1, GT2 and GT3 is made to be in inverse proportion of the radiant power of the opposite fluorescent materials. Since a fluorescent material for red has a low radiant efficiency and that for blue has secondly low radiant efficiency in general, the number of the emitters to be provided for each of the gate lines GT1, GT2 and GT3 is allowed to have a tendency similar to that in the case where the foregoing optical filters R, G and B are employed.

Although the gate lines GT1, GT2 and GT3 shown in FIG. 4 have the emitters by different numbers formed at different densities in the same areas, another structure may be employed in which the numbers of the emitters per unit areas are made to be the same and the areas in which the emitters are provided are made to be different from one another to make the number of the emitters to be different among the gate lines GT1, GT2 and GT3.

Figure 8:
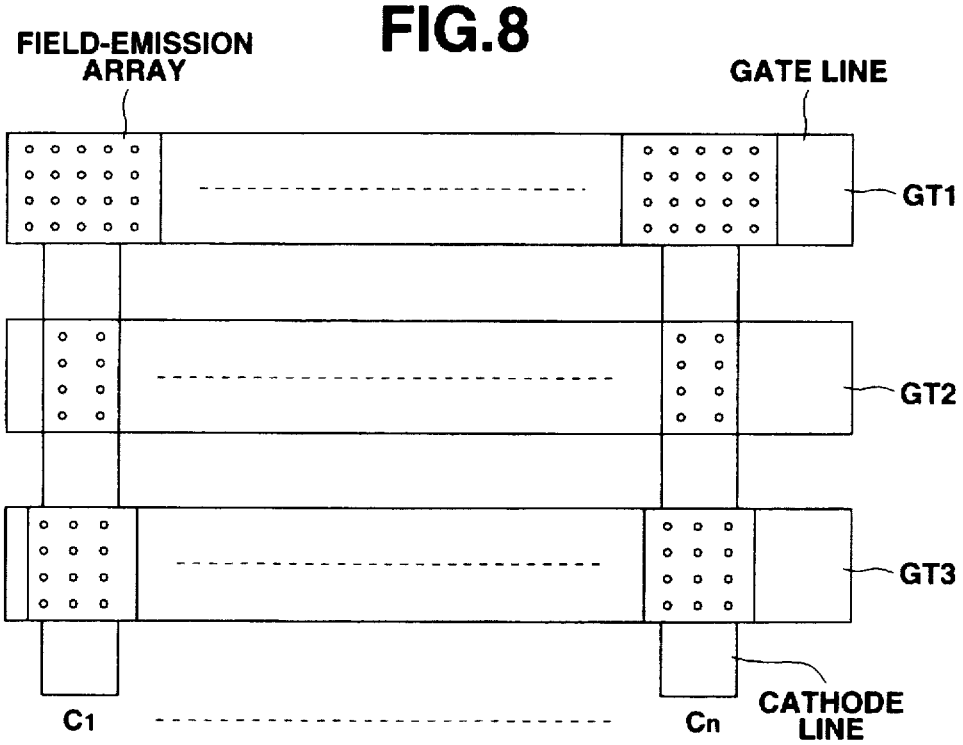
FIG. 8 is a diagram showing the structure of the gate lines and the cathode lines according to a first modification of the field-emission print head according to the present invention.
Figure 9:
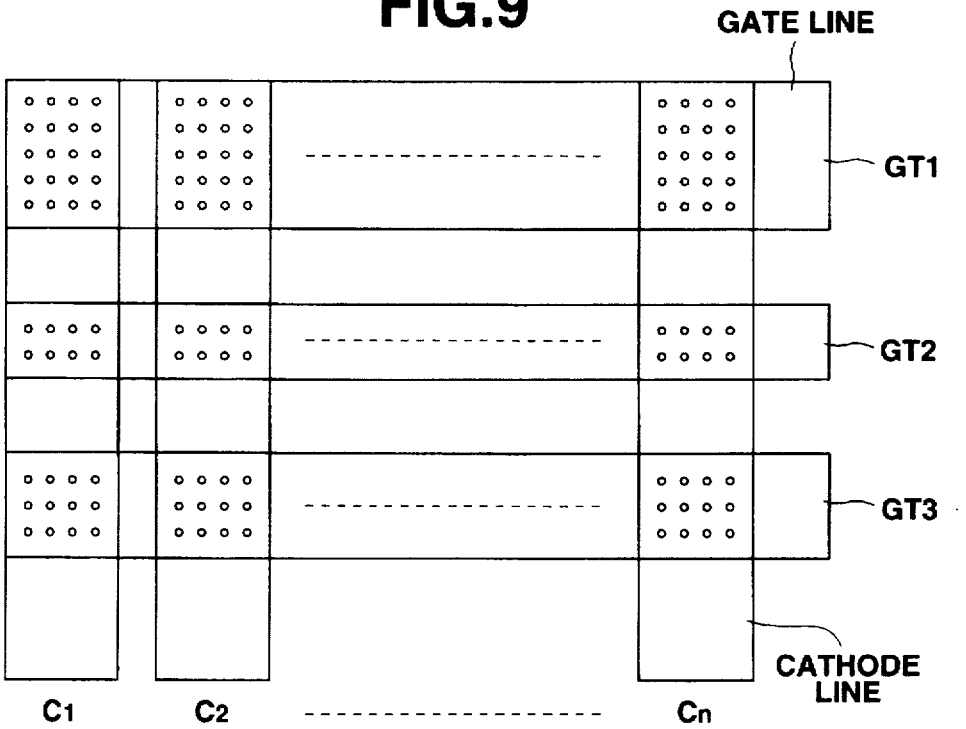
FIG. 9 is a diagram showing the structure of the gate lines and the cathode lines according to a second modification of the field-emission print head according to the present invention.

The structures of the gate lines GT1, GT2 and GT3 and the cathode lines Cl to Cn in the foregoing case are shown in FIGS. 8 and 9. FIG. 8 shows a structure in which the gate lines GT1, GT2 and GT3 have the same widths and the cathode lines Cl to Cn have widths which are in inverse proportion to the radiant efficiencies of the opposite fluorescent materials.

FIG. 9 shows a structure in which the cathode lines Cl to Cn have the same widths and the gate lines GT1, GT2 and GT3 have widths which are in inverse proportion to the radiant efficiencies of the opposite fluorescent materials.

In the case where the emitters are formed on each gate line in inverse proportion to the radiant efficiencies of the fluorescent materials or the transmittance efficiencies of the respective optical filters, a structure may be employed in which the emitters are formed on the overall surface of the cathode lines to determine the number of the effective emitters by forming the gate lines because the effective emitters are those formed in a portion in which the gate line and the cathode line overlap.

Since the present invention is structured as described above, only one voltage level is required to be applied between the gate and the cathode when the field-emission print head is operated. Moreover, only one power supply circuit for supplying electric power to the cathode driver group is required. Therefore, the operation circuit can be simplified and the number of parts can be decreased so that the cost of the field-emission print head is reduced.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A field-emission device comprising:

a plurality of cathode lines formed on a cathode substrate;

a plurality of gate lines formed on said cathode lines through an insulating layer in such a manner that said plurality of gate lines are formed perpendicular to said cathode lines;

a plurality of emitters formed in portions in which said cathode lines and said gate lines overlap in such a manner that said plurality of emitters are formed on said cathode lines disposed in openings formed in said gate lines; and an anode substrate disposed opposite to said cathode substrate and having a plurality of anode lines covered with fluorescent layers of different colors in portions opposite to said plurality of gate lines, wherein the number of said emitters formed opposite to said fluorescent layers is in inverse proportion to radiant efficiencies of said opposite fluorescent layers for respective colors.

2. A field-emission device according to claim 1, wherein the widths of said cathode lines in the portions in which said cathode lines and said gate lines overlap are changed to make said number of said emitters to be in inverse proportion to said radiant efficiencies of said opposite fluorescent layers for the respective colors.

3. A field-emission device according to claim 1, wherein the widths of said gate lines in the portions in which said cathode lines and said gate lines overlap are changed to make said number of said emitters to be in inverse proportion to said radiant efficiencies of said opposite fluorescent layers for the respective colors.

4. A field-emission device according to claim 1, wherein the widths of said cathode lines and the widths of said gate lines in the portions in which said cathode lines and said gate lines overlap are changed to make said number of said emitters to be in inverse proportion to said radiant efficiencies of said opposite fluorescent layers for the respective colors.

5. A field-emission device comprising:

a plurality of cathode lines formed on a cathode substrate;

a plurality of gate lines formed on said cathode lines through an insulating layer in such a manner that said plurality of gate lines are formed perpendicular to said cathode lines;

a plurality of emitters formed in portions in which said cathode lines and said gate lines overlap in such a manner that said plurality of emitters are formed on said cathode lines disposed in openings formed in said gate lines;

an anode substrate disposed opposite to said cathode substrate and having a plurality of anode lines covered with fluorescent layers of different colors in portions opposite to said plurality of gate lines; and color filters using light emitted from said fluorescent layers to obtain a plurality of emitted light colors and disposed opposite to said anode lines, wherein the number of said emitters formed opposite to said fluorescent layers is in inverse proportion to radiant efficiencies of said corresponding color filters for respective colors.

6. A field-emission device according to claim 5, wherein the widths of said cathode lines in the portions in which said cathode lines and said gate lines overlap are changed to make said number of said emitters to be in inverse proportion to said radiant efficiencies of said corresponding color filters for the respective colors.

7. A field-emission device according to claim 5, wherein the widths of said gate lines in the portions in which said cathode lines and said gate lines overlap are changed to make said number of said emitters to be in inverse proportion to said radiant efficiencies of said corresponding color filters for the respective colors.

8. A field-emission device according to claim 5, wherein the widths of said cathode lines and the widths of said gate lines in the portions in which said cathode lines and said gate lines overlap are changed to make said number of said emitters to be in inverse proportion to said radiant efficiencies of said corresponding color filters for the respective colors.

* * * * *